United States Patent [19]

Graillat et al.

[11] 4,454,663

[45] Jun. 19, 1984

[54] SKI BOOT HAVING LATERAL RIGIDIFYING MEANS

[75] Inventors: Gerard Graillat, Annecy; Serge Pradier, Alby-sur-Cheran; Georges P. J. Salomon, Annecy, all of France

[73] Assignee: Etablissements Francois Salomon & Fils S.A., Annecy, France

[21] Appl. No.: 336,171

[22] Filed: Dec. 31, 1981

[30] Foreign Application Priority Data

Jan. 9, 1981 [FR] France ..... 81 00684

[51] Int. Cl.[3] ..... A43B 5/04

[52] U.S. Cl. ..... 36/120

[58] Field of Search ..... 36/117, 118, 119, 120, 36/121

[56] References Cited

U.S. PATENT DOCUMENTS 3,529,369 9/1970 Drago ..... 36/120

4,143,474 3/1979 Blanc ..... 36/120

FOREIGN PATENT DOCUMENTS 1963342 6/1971 Fed. Rep. of Germany .

1785151 7/1971 Fed. Rep. of Germany .

2043287 3/1972 Fed. Rep. of Germany .

2205470 8/1973 Fed. Rep. of Germany .

2711506 11/1978 Fed. Rep. of Germany .

2063622 9/1971 France .

*Primary Examiner*—Patrick D. Lawson

*Attorney, Agent, or Firm*—Sandler & Greenblum

[57] ABSTRACT

A ski boot including a shell base with a sole on its bottom, and a calf, the calf being adapted to accommodate the leg of a skier and being pivotably mounted to the shell base along a first pivot axis. The shoe further includes at least one vertical extension extending from the shell base, the calf being pivotably secured along a second pivot axis on the extension.

26 Claims, 10 Drawing Figures

SKI BOOT HAVING LATERAL RIGIDIFYING MEANS

BACKGROUND OF THE INVENTION

1. Field of the Invention

The present invention relates to a ski shoe or boot composed of a calf and shell base molded out of rigid plastic material substantially surrounding the foot, having a sole underneath. The upper portion of the zone surrounding the heel and the malleoli is provided with journal means allowing for the pivoting of the calf relative to the base shell.

Description of Prior Art

Ski boots of different shapes and configurations are known which operate based upon different principles so as to be relatively rigid, and which provide good comfort and technical characteristics. More particularly, with respect to the flexional control of the calves of ski boots, various possible solutions are known which rely upon metallic spring blades positioned on both sides of the shoe calf. Examples of such apparatus are described in German Application Nos. 17 85 151, 21 63 622, and 22 05 470. The flexional properties of the calf along the longitudinal axis of the boot are assured by the same lateral rigidification means, i.e., lateral steel spring blades secured, respectively, in the shell base and at the top of the calf.

However, such constructions suffer from various disadvantages. In boots containing metallic spring blades on both sides of the calf the elastic metallic blades serve simultaneously contradictory functions, i.e., to allow elastic deformation in the longitudinal direction, and to provide rigidification in the direction transverse to the calf. When it is desired to modify one of these functions, such modification is always achieved to the expense of the other by virtue of the metallic structure of these lateral blades. Furthermore, the insertion of metal in the lateral walls of the calf leads to a much heavier boot construction, which necessitate more complicated molds, and which are, therefore, more costly.

Finally, it is noted that such boots permit only an inappropriate angular displacement in flexion, since these blades are rigidly anchored in the journal zone of the malleoli, while the flexible journal of the calf is positioned above the malleoli in the zone of the shin, corresponding to the lower portion of the peroneal tibia segments, which considerably detracts from the wearing comfort of such boots.

Boots are also known of the type described in French Pat. No. 2,063,622, which rely upon lateral metallic reinforcements provided with journals generally at the level of the malleoli; the journals being themselves linked by spiral springs assuring the elastic connection so as to guarantee the flexion between the top of the calf and the shell base.

As to this latter type of construction, it should be noted that it does attempt to overcome the disadvantages of the boots of the prior art, whose lateral security of the ankles necessarily results in a reduction of the possible flexion of the calf. However, this solution of the prior art suffers from various other inconveniences. In effect, the solution of providing lateral reinforcement journals allowing for frontward flexion results in a complexity of assembly of the boot which is increased by added apparatus assuring the elastic return of the calf after flexion. This complexity of design renders the assembly of such boots costly. Furthermore, the combination of the rigidification and elastic deformation functions at the level of the journalled reinforcement alone affects the reliability and even the strength of the device. Finally, this type of construction, where the reinforcements are embedded in the walls of the shell themselves, adds weight which affects the comfort of the ski boot, which is already strongly compromised by the very nature of this type of boot.

SUMMARY OF THE INVENTION

Broadly, the invention is directed to a ski boot including a shell base with a sole on its bottom, and a calf. The calf is adapted to accommodate the leg of a skier and is pivotably mounted on the shell base along a first pivot axis. The shoe further includes at least one vertical extension extending from the shell base. The calf is pivotably secured along a second pivot axis on the extension. The shell base is rigid and substantially encases the foot. In a preferred embodiment the extension is integral with the shell base and is molded of plastic material.

The vertical extension extends vertically approximately parallel to the axis of the calf beginning at a point in the zone extending from the front of the heel to the malleoli.

Preferably, the ski boot comprises two vertical extensions positioned on opposite sides of the shell base to provide lateral rigidity to the ski boot.

The calf may be a single unit or alternatively comprise a front cuff and a rear spoiler, the cuff being distinct from but coupled to the spoiler. In this instance, the cuff and the spoiler may be coupled together and journalled on the shell base at a single pivot point along the first pivot axis.

In one embodiment the calf and the extension are permanently pivotably affixed along the second pivot axis. According to another embodiment the calf comprises a front cuff and a rear spoiler and the front cuff comprises a pivotable latch adapted to pivotably secure the extension to the wall of the cuff along the second pivot axis in a manner such that the latch can be unlatched when the boot is not used during skiing, e.g., during walking. A member is provided which is adapted to extend from the extension through a slot in the wall of the cuff to be latched by the latching member. The slot in the wall of the cuff is arcuate whereby the cuff is free to move relative to the extension when the latch is in the open position such as during walking.

The extension may have parallel vertically extending edges as well as vertically extending edges which converge towards the top of the calf. Furthermore, the extension may comprise a slot therein extending vertically along at least a portion of the extension. The slot is a central oblong slot which may have the shape of a parallelogram. A cursor may be movably positioned in the slot so as to limit the spacing of the edges of the slot; the cursor affecting the rigidity of the extension as a function of its position in the slot.

According to yet another embodiment, the second pivot axis is adjustable as to its vertical position along the extension. To accomplish this the extension has an oblong slot. An adjustment plug is provided comprising at least one protrusion adapted to fit within a recess in the wall of the calf, the protrusion being adapted to extend through the slot to secure the calf to the extension and to establish the second pivot axis. The adjustment plug further comprises a slide adapted to seat within a track in the slot, the track guiding the plug and holding the plug on the extension.

BRIEF DESCRIPTION OF THE DRAWINGS

The invention will now be described with reference to the annexed drawings, illustrating various embodiments, in a non-limiting fashion, in which.

DESCRIPTION OF PREFERRED EMBODIMENTS

Figure 1:
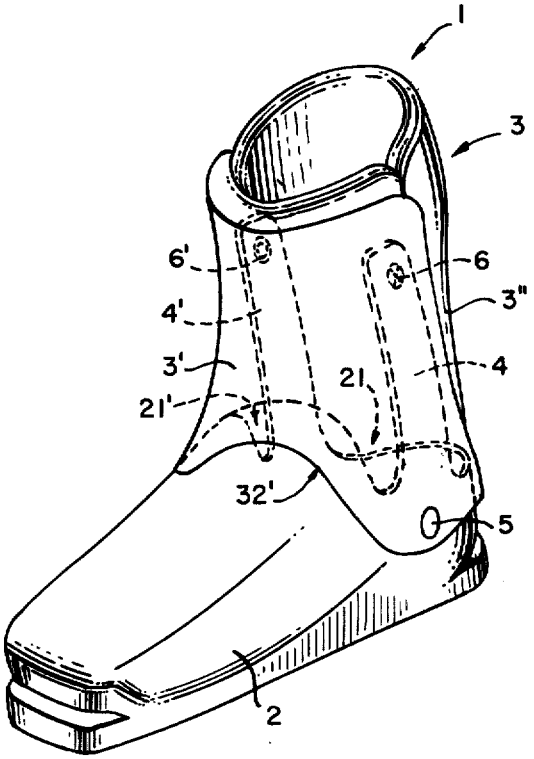
FIG. 1 is a perspective view of a ski boot according to the invention, in which the shell base, provided with two elastic blades forming lateral extensions, is shown in solid lines, while the calf, formed of two journalled portions (a cuff and spoiler), is shown in broken lines.

The present invention overcomes the disadvantages of prior art ski boots, and provides a ski boot whose flexional properties of the calf with respect to the shell base include an elastic-return or spring-back property. Additionally, in order to accomplish a principal aim of the invention, which is to provide a ski boot in a simple and efficient manner by utilizing modern plastic materials as the means for controlling the angular flexion of the calf, as well as its return and/or spring-back elastic means, additional adjustment means for adjusting these elastic-return characteristics may be provided.

The ski boot, according to one preferred embodiment of the invention, has a rear insertion capability which comprises a rigid shell base essentially surrounding the foot provided with a sole. The upper portion of the zone surrounding the heel and the malleoli is provided with at least one pivot axis on which a relatively rigid calf surrounding the bottom of the leg of the skier is journalled. In this embodiment, the calf itself is composed of at least one rear portion or spoiler serving as a support for the bottom of the leg, and at least one front portion or cuff assuring the closure of the boot. The boot is characterized in that the shell base comprises, respectively, on each side of the malleoli, a vertical extension in the form of a deformable elastic blade extending approximately parallel to the axis of the calf from the zone surrounding the heel. The calf contains a second pivot axis with the shell base provided at one point, situtated above the first pivot axis, along the length of the extension.

Nevertheless, the invention is not limited to boots in which insertion of the foot occurs from the rear, and it is possible to apply the invention to ski boots of the front-insertion type.

Another aim of the invention is to obtain flexional characteristics of the calf to provide a good shock-absorption capacity of the flexional forces sustained with a sufficient elastic return for small forces while providing a good lateral security to the leg.

These aims are achieved with the boot according to the invention by virtue of its particular structure. In effect, it is the vertically extending lateral extensions extending upwardly from the rigid shell base which assure flexional control, as well as the elastic return, while the calf, and more particularly the spoiler journalled on the shell, which, by virtue of its shape, envelopes the leg in a tubular fashion, and assures the necessary lateral rigidity and security for the bottom of the leg of the skier.

Finally, another aim of the invention is to provide "rear insertion" boots whose cuff cooperates with the top of the shell base in the approximate zone of the instep to resist permanent deformation which occurs at the lower edge of the front portion of the calf after repeated periods of use. Furthermore, this cooperation zone between the shell base and the lower edge of the calf is determinative in establishing of the rigidity of the calf, whose curve of values increases sharply. It is with a view towards modifying the characteristics of the rigidity curve of the calf that the construction according to the invention has also been developed.

Additionally, the great advantage of this type of construction resides in the fact that the lateral extensions are formed directly during the same molding step as the shell base, whose unique material assures both lightness and good mechanical characteristics linked with simplicity of production.

Various embodiments of the boot according to the invention can be provided. Thus, depending on the possibilities of adjustment that one wishes to obtain for a finer modulation of the flexional characteristics and elastic-return qualities, the lateral extensions in the form of elastic blades will be connected to the front portion of the calf, called the cuff, at a distance which is more or less raised above the journal axis of the calf on the shell base. It is likewise possible, according to this concept, to provide an attachment apparatus for attaching the calf to the extensions which varies the distance of the upper pivot axis from the lower first pivot axis along the height of the calf such that, depending upon the level of the skier's abilities, the flexional conditions of the boot can be adjusted to suit the skier's needs.

According to another embodiment, a different manner of varying the flexional and elastic-return characteristics is provided by providing at least one of the lateral elastic blades with an oblong slot which serves effectively to diminish the cross-section of the beam constituted by the elastic blade.

In another embodiment, the boot according to the invention is provided with a latching means between the elastic blades and the cuff which is removable or retractable to allow for the possibility of totally eliminating the return and/or flexion of the calf provided by the blades. As a result of this, the calf is connected to the shell base only at its lower first pivot axis. One thus obtains good angular deflection in the longitudinal perpendicular plane of the boot, which facilitates walking.

It is also possible to provide an alternative embodiment for a ski boot having insertion through the front. In this case, the lateral extensions still originate at the shell base and extend upwardly substantially the length of the calf, but the calf in this embodiment comprises a single, relatively rigid element surrounding the bottom of the leg of the skier. The calf is connected at its upper portion to the lateral elastic blades by known assembly means, while the calf can be opened to the foot when the boot is to be put on.

Figure 2:
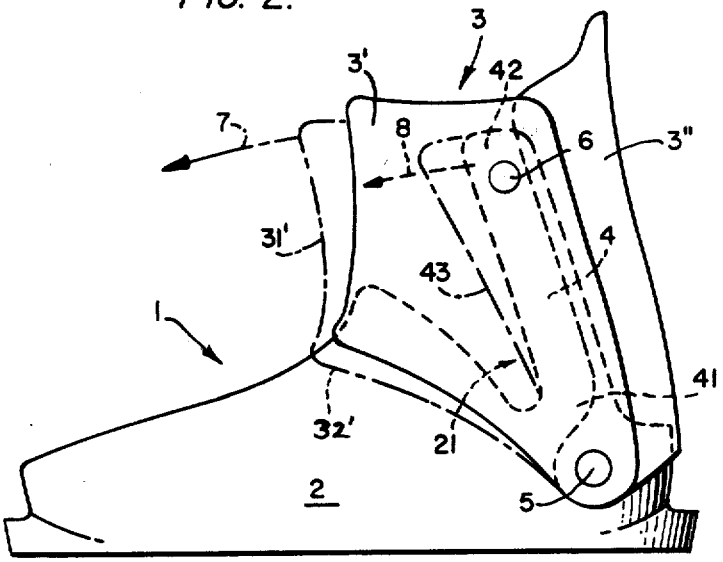
FIG. 2 is a side elevational view of the boot according to the invention in the normal, static position, with the flexed position being shown in dashed lines.

Referring to the embodiment illustrated in FIGS. 1 and 2, ski boot 1 comprises a shell base 2 made of rigid plastic material on which a calf 3 surrounding the bottom of the leg of the skier is journalled. This calf itself comprises a front calf portion 3', called a cuff, and a rear portion 3", called a spoiler. In the case of the embodiment described, the cuff and spoiler 3', 3" are simultaneously journalled on the same pivot axis 5, situated approximately in the zone of the shell base adjacent to the malleoli of the skier. Furthermore, shell base 2 entirely encases the front of the foot up to the zone of the instep, as well as in the zone of the heel. The base is generally slipper-shaped, which advantageously facilitates putting on the boot through the rear.

Quite obviously, tightening and locking means of the cuff and of the spoiler may be provided on the calf; these means not being shown for purposes of clarity.

According to one of the principal characteristics of the boot according to the invention, the shell base 2 comprises, on both sides of the malleole zone and above the pivot axis 5, an extension originating from the shell base, which extends above the zone of the malleoli, in the form of two lateral blades 4 and 4' positioned substantially parallel to the longitudinal median plane of the boot. The two lateral blades 4 and 4' are substantially of the same thickness as the walls of the shell base, and extend upwardly along the general axis of the calf 3 of the boot 1. The lateral elastic blades 4 and 4', which extend up to a height which is approximately equal to that of the calf, are equivalent to beams anchored at one of their ends, i.e., at their bases 41, 41'. These blades can be provided at their bottom or base 41, 41', with a width which is greater than along the rest of the blade, which leads to a modification of the original flexional characteristics.

In the case of FIGS. 1 and 2, a ski boot according to the invention has been shown which is provided with lateral elastic blades 4, 4' whose edges are each parallel. At the upper portion or top 42, 42' of the lateral blades 4, 4', second attachment points 6, 6' of the shell base 2 with the calf 3 are provided. These attachment points 6, 6' are provided by known assembly means such as rivets, clips, screws, etc. This second attachment point, which is an essential aspect according to the invention, assures the cooperation of the calf with the lateral blades during the various phases of active use of the boot.

As shown in FIG. 2, when the skier exerts a frontwardly-directed flexion in the direction shown by arrow 7 in dashed lines, cuff 3' flexes frontwardly (along the position shown in dotted lines 31'), and causes the same frontward force to be exerted on lateral blades 4, 4'. The blades flex as shown in the advanced position in dashed lines 43 at their upper ends 42, 42'. The flexional force shown by arrow 8 to which the blades 4, 4' are subjected is applied to the linkage points 6, 6', and acts, as a result, on the blades, as a force applied to the end of a cantilevered beam. However, as soon as the flexional force stops being applied to cuff 3', force is no longer applied to the lateral extension blades 4, 4'. By virtue of the elasticity of the plastic material itself of which the blades are made, as well as by virtue of their connection with respect to the direction of the flexional forces, the forces are approximately contained in the same plane as the blades. The blades thus act as beams of rectangular cross-section positioned such that one thus obtains a quadratic moment of inertia which is relatively substantial for the mass which the beams represent, and consequently, one thus obtains a very low deformation under flexion, and thus better elastic resistance (greater rigidity). It follows likewise that one achieves an excellent elastic return of the lateral blades 4, 4', and consequently of the calf assembly 3.

Another advantage of this type of construction according to the convention is obtained by virtue of the fact that the inventive apparatus makes it possible to compensate for the eventual permanent deformation of the bottom 32' of the cuff 3' which occurs when the cuff slides and rests against the top of the shell base 2 during repeated flexions. This ablility to compensate is made possible by virtue of the fact that the shell base 2 has an upper edge running along the top of the zone of the instep, which forms on each side of the foot a sort of cut-out 21, 21' having a "V" shape. This cut-out 21 allows, within acceptable human physiological limits, for the frontward angular deflection of the lateral elastic blades 4, 4' during flexional movements of the leg of the skier.

Figure 3:
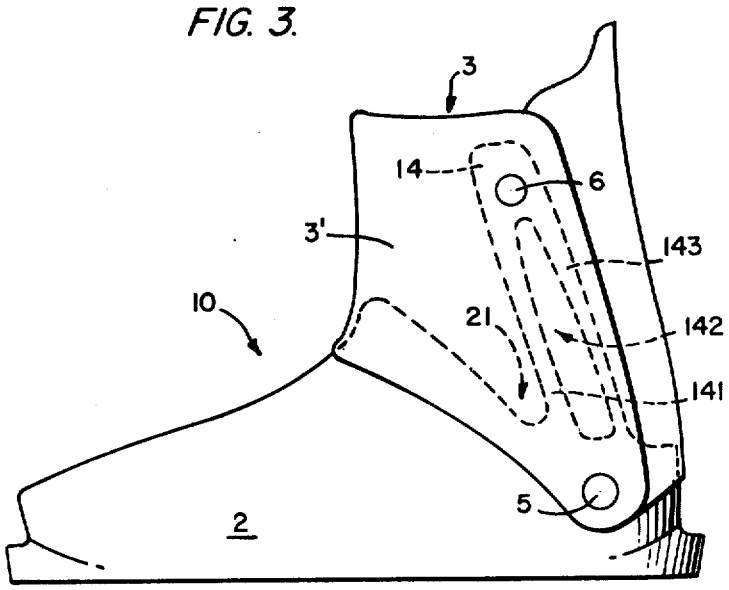
FIG. 3 is a side elevational view of another embodiment of the boot according to the invention, where the lateral elastic blades are provided with an opening in their middle to modify their flexional and elastic-return characteristics.

FIG. 3 illustrates an alternative ski boot 10 according to the invention, where only the shell base 2 and calf 3 have been shown, so as to not complicate the drawing.

In this embodiment, lateral elastic blades 14, 14' (only blade 14 will be mentioned, since the boot is shown in side view) beginning at shell base 2 are cut by an oblong slot 142 defining, as a result, two tie beams 141 and 143. The principle of operation is similar to that which has been previously described for FIGS. 1 and 2. In this embodiment, blade 14, which is still connected to cuff 3' by attachment means 6, which are known in themselves, differs from that which has been previously described by the structure of the blade 14, whose flexional characteristics are fundamentally modified. The quadratic moment of inertia of the two tie beams 141 and 143 becomes less substantial, which allows for greater deformation. This makes it possible to employ materials having greater natural rigidity for the shell base 2 (and consequently the vertical extensions), while making it possible to preserve good elastic-return properties.

Figure 4:
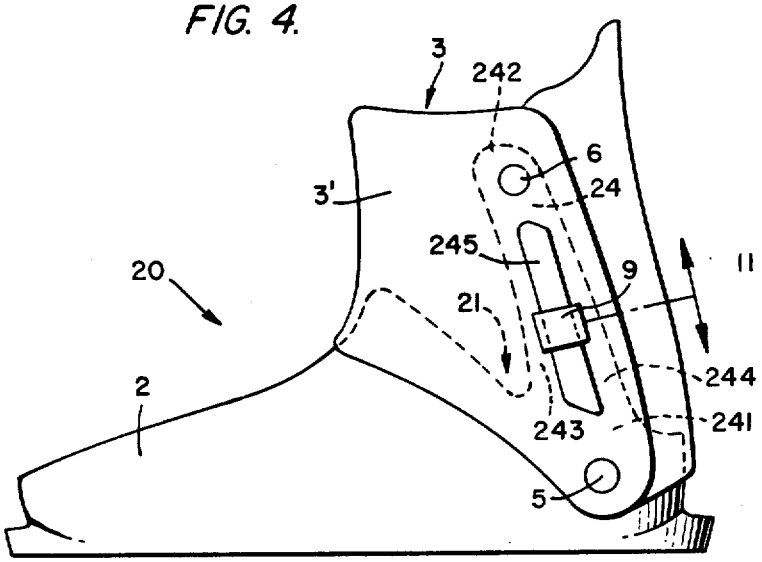
FIG. 4 is a side elevational view of the same type of boot as shown in FIG. 3, but with the lateral elastic blades provided with slots, with a rigidifier provided in the slots for varying the flexional elastic-return characteristics, depending upon the position of the rigidifier.

FIG. 4 illustrates a variant of the boot shown in FIG. 3. In this embodiment, the lateral elastic blade 24 of boot 20 comprises, between the non-parallel edges, on oblong slot 245 having the general shape of a parallelogram. Furthermore, the lateral elastic blade comprises a base 241 of greater width than its head 242, situated at a height substantially equal to that of the calf 3 of the boot 20, while the slot 245 extends from the base 241 until the zone of the attachment point or pivot axis 6.

According to a complementary aspect of the invention, it is possible to vary the flexional characteristics of the lateral blade 24, whose interior edges are spaced by virtue of a cursor 9, which can be moved along the length of the slot 245, as indicated by double arrow 11. The operation of boot 20 remains similar to that of the boots previously described, besides having the supplemental possibility of modulating the flexion of the calf, depending upon the position occupied by cursor 9 in slot 245. So as to maintain the selected position of the cursor, even when the boot is subjected to strong mechanical forces due to the irregularities of the terrain, the cursor may be provided with stop means or a rack in the slot itself provided with corresponding means such as teeth, serrated or embossed rollers, etc., known in themselves, which have not been shown so as not to detract from the clarity of FIG. 4.

Figure 5:
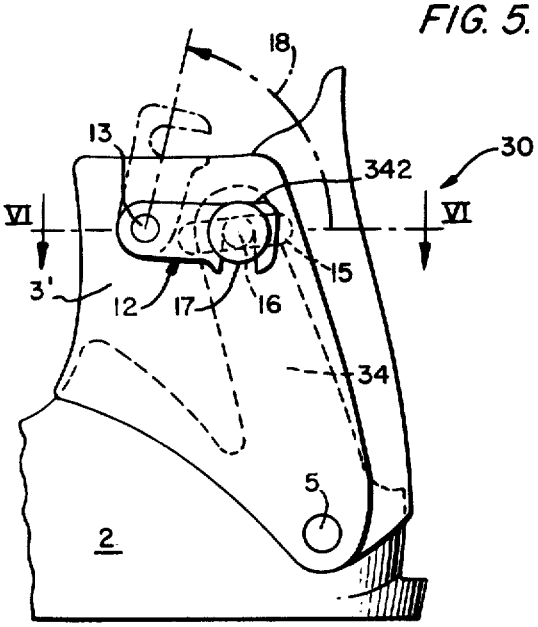
FIG. 5 is a partial side elevational view of another embodiment of the boot according to the invention, in which the elastic lateral blades beginning at the bottom of the shell base are attached at the lateral upper portion of the cuff by latching means.
Figure 6:
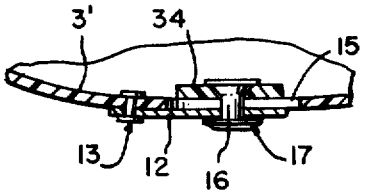
FIG. 6 is a partial cross-sectional view of the latching means used in the preceding figure.

FIGS. 5 and 6 illustrate another embodiment of a boot 30 according to the invention where the lateral elastic blade 34 is connected to cuff 3' at its upper portion 342 by a releasable latching apparatus. By way of example, this apparatus can comprise a latch 12 journalled on an axis 13 positioned at the upper portion of the cuff 3' at the height of the upper linkage point 16. The latch is adapted to be secured to an attachment nipple attached to the lateral extension blade 34. This attachment nipple 16 is constituted, in the case shown in the Figure, by a flat-head rivet 17, and extends to the exterior of the wall of cuff 3' across an arcuate slot 15, having its center of rotation on journal axis 5 of calf 3. Slot 15 has a length such that it allows for the angular deflection of the calf 3, as a result of the walking gait when latch 12 is unhooked from the attachment nipple 16, as shown by fine dashed lines 18. Boot 30 is thus provided with a first position of use, known as the "ski position", with calf 3 having good flexional properties and good elastic-return properties, and a second use position, known as the "walking position", with calf 3 being free to pivot around journal axis 5. Of course, it is possible to adapt this type of construction to the slotted lateral blade structure disclosed above, with or without a flexion-control cursor.

Figure 7:
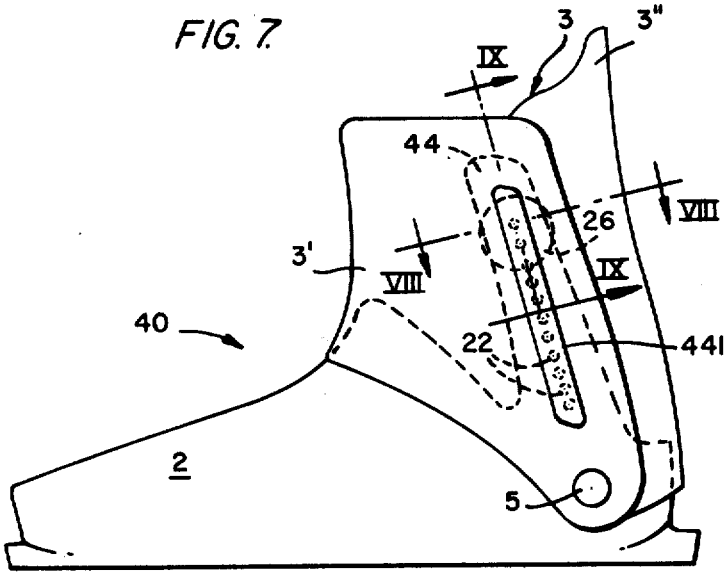
FIG. 7 is a side elevational view of another embodiment according to the invention whose elastic lateral blades originating at the shell are attached to the cuff by attachment means whose position along the length of the lateral extensions is adjustable.
Figure 9:
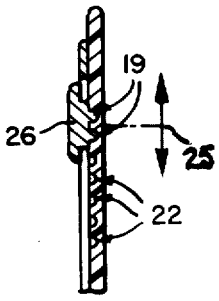
FIGS. 8 and 9 are partial cross-sectional views of the adjustable attachment means used in the boot of FIG. 7.
Figure 8:
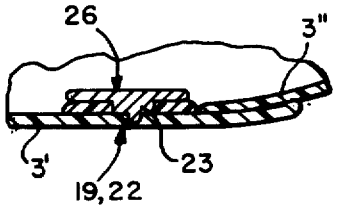

FIGS. 7, 8, and 9 shown an embodiment of boot 40 according to the invention in which lateral elastic blade 33 extends substantially over the length of the calf, and comprises a slot provided substantially over its entire height. However, contrary to the embodiments described above, the upper point of linkage between the blade 44 and cuff 3' is no longer at a fixed, predetermined position, but can, by virtue of an adjustable linkage apparatus 26, assure attachment at different points between the lower or first pivot axis 5 and the uppermost pivot axis. It is adapted such that, from a purely mechanical point of view, it is possible to vary the position of the point of application of the force on the cantilevered beam at one of its ends. Consequently, a variation of the flexional properties occurs, depending upon the position of the adjustable attachment apparatus 26 along the slot 441 of the blade 44. Depending upon the degree of flexion of the calf sought by the skier, the position of the adjustable attachment apparatus 26 along the calf 3 can be varied by means of plugs 19. The plugs are adapted to have protrusions be embedded in recesses 22 provided for this purpose on the internal surface of the wall of cuff 3' (FIGS. 8 and 9). Plugs 19 extend beyond the guide surface 23 which functions as a slide for the attachment apparatus. Slide 23 has the shape of a rounded tail (FIG. 8) fitting within the hollow space within slot 441 having a corresponding cross-section, such that the device cannot leave the slot. To change the position of the attachment device 26, the skier spaces the lateral elastic blades 44 from the wall of cuff 3', which makes plugs 19 leave their recesses 22, and the skier slides the apparatus 26 (along the direction of the double arrow 25 of FIG. 9) to the height selected along blades 44 to make plugs 19 face the new recesses 22 situated higher or lower than the original position occupied by the attachment apparatus. The release of the lateral blades 44 towards the wall of the cuff 3', makes the plugs 19 penetrate the recesses 22 selected, thereby providing a new degree of flexibility to the calf.

The invention is not limited only to the embodiments described above. Thus, without going beyond the scope of the invention, it is possible to adapt the structural principles of the lateral elastic blades to ski boots having calves which are higher or lower, depending upon the tendencies and the requirements, as well as the skiing technique of the market in which it is to be used.

Figure 10:
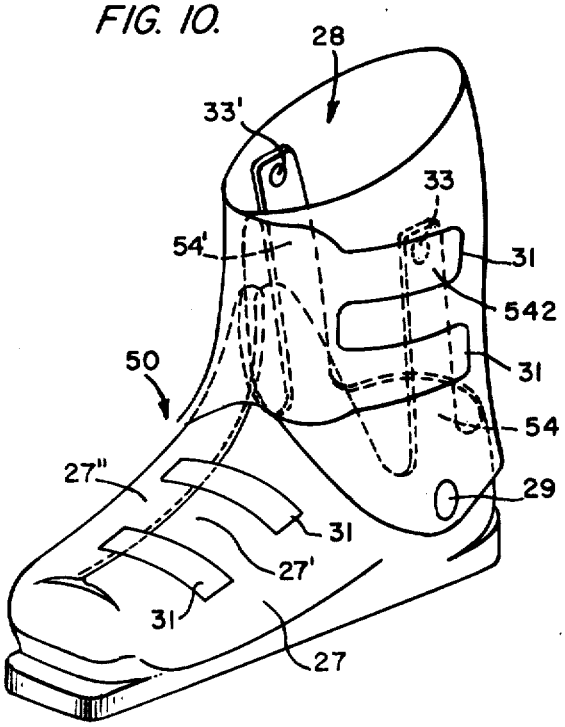
FIG. 10 is a perspective view of a ski boot according to the invention allowing for front insertion in which the shell base is provided with two lateral extensions extending upwardly substantially the length of the calf to be connected by attachment means. The shell base and the extensions, as well as the linkage points, are shown in dark solid lines, while the calf is shown in fine lines.

FIG. 10 illustrates another possible embodiment of a ski boot according to the invention. In this case, boot 50 is of the front-insertion type, wherein the lateral elastic blades 54, 54' likewise beginning at shell base 27 allow for the boot to be put on from the front, by virtue of an opening between the two convering portions 27 and 27' at the top of the foot. The rear of the shell base is cut away around the zone at the front of the malleoli and the heel. In this zone, lateral blades 54 and 54' extend upwardly along the general axis of calf 28 of the boot. Calf 28 is made of a single element surrounding the bottom of the leg, and is connected to the shell base 27 by pivot axis 29 and to the upper portion 542 of the lateral elastic blades 54 and 54', forming an integral portion of the shell base by virtue of attachment means 33 and 33'. The operation of such boot remains similar to that of the rear-insertion boot previously described. In effect, when calf 28 is closed in the position of use by virtue of locking means 31 schematically illustrated in the Figure, the compact shell-calf assembly thus formed exhibits the functional properties previously described.

Furthermore, it is likewise possible to vary certain functional characteristics by the intercombination of various aspects of the embodiments described above. It is, furthermore, possible to provide slots and lateral elastic cams having edges which may or may not be parallel, and by using shell base materials, and cursors which are very different, depending upon the needs and/or industrial technological necessities.

What is claimed is:

1. A ski boot comprising a shell base with a sole on its bottom, and a calf, said calf being adapted to accommodate the leg of a skier and being pivotably mounted to said shell base along a first pivot axis, said shoe further comprising at least one vertical extension extending from said shell base, said calf being pivotably secured along a second pivot axis on said extension.

2. The ski boot as defined by claim 1 wherein said shell base is rigid and substantially encases the foot.

3. The ski boot as defined by claim 1 wherein said vertical extension extends vertically approximately parallel to the axis of said calf beginning at a point in the zone extending from the front of the heel to the malleoli.

4. The ski boot as defined by claim 1 wherein said calf is a single unit.

5. The ski boot as defined by claim 1 wherein said calf comprises a front cuff and a rear spoiler, said cuff being distinct from but coupled to said spoiler.

6. The ski boot as defined by claim 5 wherein each of said cuff and said spoiler are coupled together and journalled on said shell base at said first pivot axis.

7. The ski boot as defined by claim 1 wherein said extension is integral with said shell base.

8. The ski boot as defined by claim 7 wherein said shell base and said extension are molded of a plastic material.

9. The ski boot as defined by claim 1 wherein said vertical extension comprises an elastic blade.

10. The ski boot as defined by claim 1 comprising two of said vertical extensions positioned on opposite sides of said shell base to provide lateral rigidity to said ski boot.

11. The ski boot as defined by claim 1 wherein said calf and said vertical extension are permanently pivotably affixed at said second pivot axis.

12. The ski boot as defined by claim 1 wherein said calf comprises a front cuff and a rear spoiler, and wherein said front cuff comprises a pivotable latch adapted to pivotably secure said vertical extension to the wall of said cuff at said second pivot axis.

13. The ski boot as defined by claim 12 further comprising a member adapted to extend from said extension through the wall of said cuff to be latched be said latching member.

14. The ski boot as defined by claim 13 wherein said slot in said wall of said cuff is arcuate whereby said extension is free to move relative to said cuff when said latch is in the open position during walking.

15. The ski boot as defined by claim 1 wherein said extension has parallel vertically extending edges.

16. The ski boot as defined by claim 1 wherein said extension comprises vertically extending edges which converge towards the top of said calf.

17. The ski boot as defined by claim 1 wherein said extension comprises a slot therein extending along at least a portion of said vertical extension.

18. The ski boot as defined by claim 17 wherein said slot is a central oblong slot.

19. The ski boot as defined by claim 18 wherein said central oblong slot has the shape of a parallelogram.

20. The ski boot as defined by claim 17 further comprising a cursor movably positioned in said slot so as to limit the spacing of the edges of said slot, said cursor affecting the rigidity of said extension as a function of its position in said slot.

21. The ski boot as defined by claim 1 wherein said second pivot axis is adjustable in position along said extension.

22. The ski boot as defined by claim 21 wherein said extension comprises a generally vertically extending oblong slot.

23. The ski boot as defined by claim 22 further comprising an adjustment plug comprising at least one protrusion adapted to fit within a recess in the wall of said calf, said adjustment plug being adapted to extend through said slot to secure said calf to said extension and to establish said second pivot axis.

24. The ski boot as defined by claim 23 wherein said adjustment plug further comprises a slide adapted to seat within a track in said slot, said track guiding said plut and holding said plug on said extension.

25. The ski boot as defined by claim 1 wherein said shell base opens in front for insertion of the foot.

26. A ski boot comprising a shell base formed of a rigid plastic material for encasing the foot of a skier and a calf pivotably secured to said shell base around a first pivot axis, said calf surrounding the lower portion of the skier's leg, said ski boot further comprising two vertical elastic extensions integral with and extending from opposite sides of said shell base, said calf being pivotably secured to each of said vertical extensions along a second pivot axis.

* * * * *